US007086343B2

(12) United States Patent
Labaune

(10) Patent No.: US 7,086,343 B2
(45) Date of Patent: Aug. 8, 2006

(54) SEWING MACHINE

(75) Inventor: René Labaune, Saint-Mandé (FR)

(73) Assignee: Elna International Corp. S.A., Plan-les-Ouates (CH)

( * ) Notice: Subject to any disclaimer, the term of this patent is extended or adjusted under 35 U.S.C. 154(b) by 0 days.

(21) Appl. No.: 11/222,160

(22) Filed: Sep. 8, 2005

(65) Prior Publication Data

US 2006/0060118 A1 Mar. 23, 2006

(30) Foreign Application Priority Data

Sep. 17, 2004 (EP) ..... 04405590

(51) Int. Cl.
*D05B 73/00* (2006.01)

(52) U.S. Cl. ..... 112/258

(58) Field of Classification Search ..... 112/258, 112/259, 260, 302, 217.1; 312/109, 126, 312/133, 138.1, 208.5, 208.6, 270.2, 311, 312/315

See application file for complete search history.

(56) References Cited

U.S. PATENT DOCUMENTS

| | | | | | |
|---|---|---|---|---|---|
| 2,617,702 | A | * | 11/1952 | Manning et al. | 312/296 |
| 3,013,514 | A | * | 12/1961 | Stanton | 112/260 |
| 3,188,993 | A | * | 6/1965 | Szuba et al. | 112/258 |
| 3,297,387 | A | * | 1/1967 | Parsons | 312/290 |
| 4,079,683 | A | * | 3/1978 | Hanyu et al. | 112/444 |
| 4,301,753 | A | | 11/1981 | Meier | |
| 4,441,443 | A | * | 4/1984 | Hrovatin et al. | 112/258 |
| 5,063,866 | A | * | 11/1991 | Jimenez et al. | 112/302 |
| 5,682,830 | A | * | 11/1997 | Katou et al. | 112/225 |
| 5,694,873 | A | * | 12/1997 | Wu | 112/302 |
| 6,062,416 | A | * | 5/2000 | Smillie | 220/524 |
| 6,652,047 | B1 | * | 11/2003 | Maguire, Jr. | 312/209 |

FOREIGN PATENT DOCUMENTS

| | | |
|---|---|---|
| GB | 1 407 112 | 9/1981 |
| JP | 62 106800 | 5/1987 |
| JP | 6 343786 | 12/1994 |
| JP | 7 289771 | 11/1995 |

* cited by examiner

*Primary Examiner*—Ismael Izaguirre
(74) *Attorney, Agent, or Firm*—Sturm & Fix LLP

(57) ABSTRACT

A sewing machine the casing of which has a storage space situated on the side facing the seamstress, in a column connecting a baseplate or a lower arm, containing a mechanism for advancing the fabric and forming the loop, to an upper arm containing the mechanism for actuating the needle bar

13 Claims, 2 Drawing Sheets

SEWING MACHINE

CROSS REFERENCE TO RELATED APPLICATIONS

This application claims priority of European Application No. 04405590.3 filed Sep. 17, 2004, which is included in its entirety by reference made hereto.

BACKGROUND OF THE INVENTION

1. Field of the Invention

The present invention relates to a sewing machine.

2. Description of the Related Art

Sewing machine accessories are stored in storage spaces situated at the top, that is to say on the upper arm bearing the needle bar and its drive mechanism and/or around the free arm of the machine. In both instances, these storage spaces do not render the sewing accessories directly accessible to the seamstress, who has to change position in order to exchange one presser foot for another, suited to the type of stitch to be performed, something which is not always easy to do during work, because this operation entails withdrawing the workpiece from the machine.

BRIEF SUMMARY OF THE INVENTION

The object of the present invention is to remedy this disadvantage, at least partially, by improving the ergonomics of the machine.

To this end, the subject of this invention is a sewing machine as claimed in claim 1.

The sewing machine according to the invention allows the seamstress to have access to all the presser feet that come with the machine and to change them as she works, without having to move in her field of view, and therefore without having to withdraw her workpiece from the machine.

The sewing machine has a storage compartment on its front face, that is to say on the face of the machine which faces the operator. The machine produced more particularly uses the right-hand upright of this front face.

Advantageously, a door closes the storage space and, on its interior face, has sewing instructions or the like. As a preference, this door is articulated along its lower edge so that opening the door does not conceal the flywheel which is situated on the right-hand side of the machine with respect to the seamstress. Furthermore, by opening this door, the instructions which are on the interior face can be read directly by the seamstress who can readily acquaint herself with and select the presser foot required according to these instructions and change the presser foot, putting the previous presser foot back in the storage space.

The attached drawing illustrates, schematically and by way of example, one embodiment of the sewing machine that is the subject of the present invention.

DETAILED DESCRIPTION OF THE INVENTION

Figure 1:
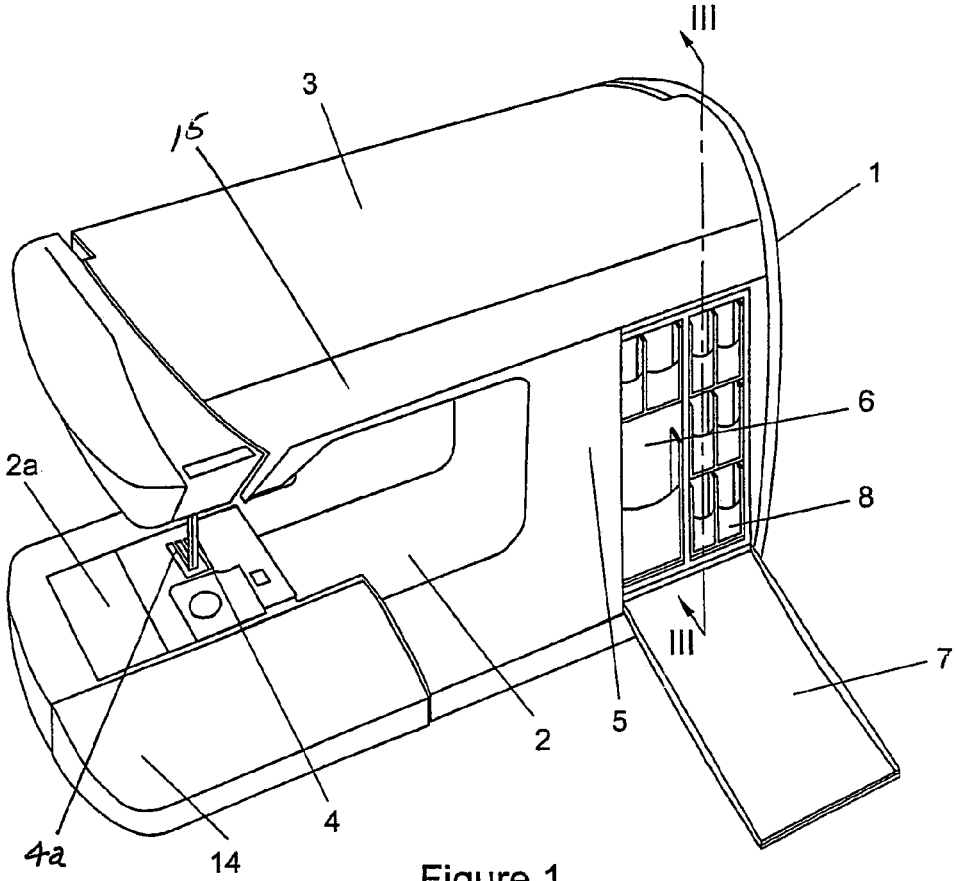
FIG. 1 is a perspective view of this embodiment.
Figure 2:
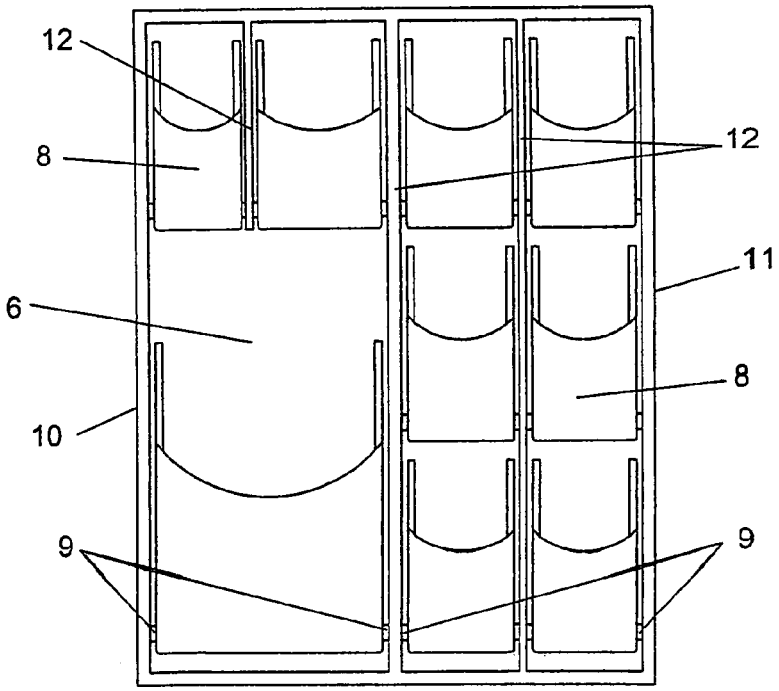
FIG. 2 is a part view in elevation of the storage space of this embodiment.

This sewing machine comprises a casing 1 which surrounds a frame B (FIG. 3) which bears its entire mechanism. This casing 1 comprises a free arm 2*a* containing the mechanism for advancing the fabric and forming the loop, as in all sewing machines. Note that this free arm 2*a* is clear of the baseplate 2 proper and runs parallel to it, so as to allow tubular shapes such as shirt sleeves or the legs of pants, for example, to be stitched. This casing 1 also comprises an upper arm 3 containing the mechanism for driving the needle bar 4 of the sewing machine. The upper arm 3 is connected to the free arm 2*a* or to the baseplate 2 by a column 5 which is situated at the right-hand end of the machine when viewed from the side at which the seamstress sits.

Figure 3:
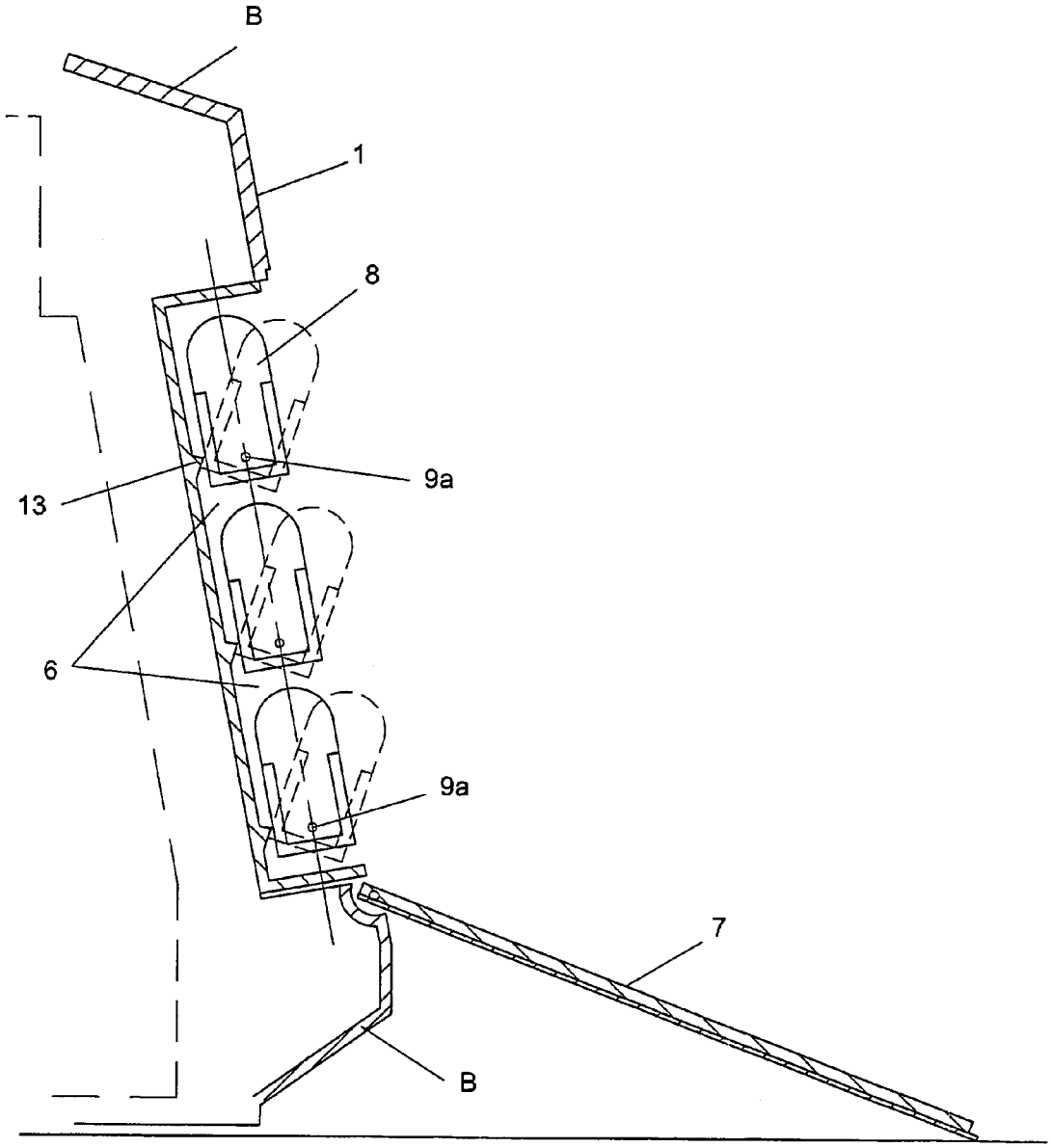
FIG. 3 is a part view in side elevation of the storage space on the line III—III of FIG. 1.

The face of the column 5 facing toward the seamstress comprises a storage space 6, preferably closed by a door 7 hinged preferably via its lower edge to the lower edge of the storage space 6 and which is depicted open in FIGS. 1 and 3, having pivoted about its lower edge. This space 6 comprises a certain number of buckets 8, of which there are nine distributed in several columns, in the example illustrated. These buckets are intended, for preference, to accept the various presser feet 4*a* which come with the machine and which are intended for carrying out the various needlework operations for which the sewing machine is designed. It is also possible to make provision for the storage space to be laid out differently, according to that which will be stored within.

Advantageously, each bucket 8 is mounted to pivot by virtue of projections 9 aligned horizontally in pairs, formed on the opposed faces of the vertical walls 10, 11 delimiting the storage space 6, and on vertical partitions 12 dividing the storage space 6 into several parts each of which, in this example, contains storage buckets 8. These projections 9 penetrate corresponding recesses 9*a* (FIG. 3) formed at the base of the side walls of the buckets 8. Elasticity of the walls of the buckets 8 and of the walls 10, 11, 12 of the storage space allows the buckets 8 to be inserted by introducing their side walls between the opposed projections 9 until the latter enter the corresponding recesses 9*a* formed at the base of the side walls of these buckets 8.

As a preference, the forward pivoting of the buckets 8 is limited as illustrated by their positions drawn in chain line in FIG. 3. For this purpose, the rear wall of the storage space 6 has stops 13 intended to limit the pivoting of the buckets 8.

The interior face of the door 7 can be used to accommodate a sewing guide (not depicted) which will inform the seamstress of the choice of presser feet 4*a* according to the type of stitching to be performed or other type of information or storage.

Once the appropriate presser foot 4*a* has been fitted, the machine is ready to sew and the door 7 can be closed again.

The other customary storage spaces can be kept for storing various supplies or other accessories.

Obviously, other embodiments of the present invention are possible without in any way departing from the scope of the present invention. Thus, the pivoting door could be replaced by a sliding door. It might also be possible to have a door that pivots about its left-hand edge or its upper edge associated, in the latter instance, with a retaining element, for example an elastic one, to keep it open. It might also be possible to anticipate a removable door, held on by a system of catches. It might also be possible to anticipate lighting which would be switched on by a contact switch operated by the opening of the door 6. The buckets 8 could also be replaced by fixed supports shaped to accommodate the various presser feet 4*a* belonging to the machine.

As may be observed in FIG. 1, the storage space 6 is not designed to replace the existing storage spaces but rather to form an additional storage space. Thus, a storage space 15 may still be found in the upper arm 3 together with a storage space 14 housed in an extension of the free arm 2*a*. The new storage space 6 can advantageously be set aside for accommodating the various presser feet 4*a* of the sewing machine or other instruments useful to the seamstress, the storage space 15 will preferably be set aside for the bobbins, for the needles and for other sewing requisites. Finally, the storage space 14 which cannot be accessed without removing the workpiece from the machine will advantageously be set aside for machine servicing equipment which does not need to be used while a workpiece is being stitched.

The invention claimed is:

1. A sewing machine comprising a casing enveloping its mechanism and having a free arm, containing a mechanism for advancing the fabric and forming the loop, an upper arm containing a mechanism for actuating a needle bar and a column connecting said free arm to said upper arm, wherein said column has a front side facing a seamstress operating the machine, and wherein said front side of said column has a storage space divided horizontally and vertically into a plurality of individual compartments, each of said compartments being disposed to receive and store one of a plurality of presser feed adapted for carrying out various needle work operations of the sewing machine.

2. The sewing machine as claimed in claim 1, in which said storage space is closed by a door.

3. The sewing machine as claimed in claim 2 in which sewing instructions are situated on an interior face of said door.

4. The sewing machine as claimed in claim 2, in which said storage space comprises positioning supports for the presser feet.

5. The sewing machine as claimed in claim 2, in which a plurality of storage buckets comprising two opposed side walls are mounted to pivot on pivot elements secured to the walls of said storage space and aligned along horizontal axes, the base of the opposed side walls of said buckets exhibiting complementary pivot elements disposed to engage with said pivot elements.

6. The sewing machine as claimed in claim 1, in which said storage space comprises positioning supports for the presser feet.

7. The sewing machine as claimed in claim 6, in which a plurality of storage buckets comprising two opposed side walls are mounted to pivot on pivot elements secured to the walls of said storage space and aligned along horizontal axes, the base of the opposed side walls of said buckets exhibiting complementary pivot elements disposed to engage with said pivot elements.

8. The sewing machine as claimed in claim 7, in which at least one vertical partition bearing some of said pivot elements divides said storage space into several parts each of which comprises at least one pair of pivot elements to accept at least one bucket.

9. The sewing machine as claimed in claim 1, in which a plurality of storage buckets comprising two opposed side walls are mounted to pivot on pivot elements secured to the walls of said storage space and aligned along horizontal axes, the base of the opposed side walls of said buckets exhibiting complementary pivot elements disposed to engage with said pivot elements.

10. The sewing machine as claimed in claim 9, in which at least one vertical partition bearing some of said pivot elements divides said storage space into several parts each of which comprises at least one pair of pivot elements to accept at least one bucket.

11. The sewing machine as claimed in claim 10, in which stop elements limit the pivoting of the storage buckets.

12. The sewing machine as claimed in claim 9, in which stop elements limit the pivoting of the storage buckets.

13. The sewing machine as claimed in claim 5, in which stop elements are intended to limit the pivoting of the storage buckets.

* * * * *